United States Patent [19]

Kudo et al.

[11] Patent Number: 5,048,267

[45] Date of Patent: Sep. 17, 1991

[54] CUTTING AND OPENING METHOD AND DEVICE FOR A RECTANGULAR PACKAGE COVERED WITH PACKAGING MATERIAL

[75] Inventors: Mutsuo Kudo; Paul Traegaardh; Masaru Gunji, all of Tokyo, Japan

[73] Assignee: AB Tetra Pak, Lund, Sweden

[21] Appl. No.: 406,447

[22] Filed: Sep. 13, 1989

[30] Foreign Application Priority Data

Sep. 13, 1988 [JP] Japan ..... 63-229667

[51] Int. Cl.[5] ..... B65B 69/00

[52] U.S. Cl. ..... 53/492; 414/412

[58] Field of Search ..... 53/492; 414/412, 411

[56] References Cited

U.S. PATENT DOCUMENTS

| | | | |
|---|---|---|---|
| 2,729,885 | 1/1956 | Wahl et al. | 414/412 X |
| 3,263,843 | 8/1966 | Grahn et al. | 414/412 |
| 3,386,320 | 6/1968 | Pinkham et al. | 414/412 X |
| 3,889,442 | 6/1975 | Grahn et al. | 414/412 X |
| 4,843,801 | 7/1989 | Roncero | 53/492 |

*Primary Examiner*—James F. Coan

[57] ABSTRACT

A cutting apparatus and opening method for a rectangular package covered with packaging material includes a platform for positioning a rectangular package. Spacing members are provided for forming a space between the packaging material and the packaged items on two mutually opposing planes of the package on the platform. A pair of cutting blades are mounted for cutting the packaging material from one edge to the other in the direction of height or width where a space is formed between the packaging material and the packaged items by the spacing members. A pair of cutting blades are also mounted for cutting the packaging material from one of the two edges other than the edges passing the starting point and the finishing point of each of the two cutting lines cut by the pair of cutting blades to the above-memtioned cutting lines. A second spacing member is provided for forming a space between the packaging material and the packaged items on the plane with two edges that pass the ends of the two cutting lines made by the pair of cutting blades. A cutting blade cuts the packaging material for connecting the two cutting lines on the above plane and a device is provided to open the packaging material from each area on the three planes provided with cutting lines.

12 Claims, 9 Drawing Sheets

A
A'
C
C1
C2
C3
C5
C6
C7
W
L1
L2
L3
L4
L

CUTTING AND OPENING METHOD AND DEVICE FOR A RECTANGULAR PACKAGE COVERED WITH PACKAGING MATERIAL

BACKGROUND OF THE INVENTION

1. Field of the Invention

A method and a device are disclosed for cutting a rectangular package covered with packaging material at a prescribed position for opening the package.

2. Description of Background Art

Various types of paper containers have been previously manufactured. For example, disposable packaging containers are widely used for liquid foodstuffs such as juice, some which are of parallelepipedic form A' as shown in FIG. 21.

In most cases, packaging container blanks A are folded flat as shown in FIG. 20 and collected in bundles with the outside covered with packaging material as shown in FIG. 1 for easy storage and handling.

In order to take packaged items out of the rectangular package C described above, the packaging material B has to be cut and opened. Formerly, this was done manually or by the method and device described in Japanese Patent Publication (unexamined) No. 271828.

SUMMARY AND OBJECTS OF THE INVENTION

Performing the above-mentioned operation manually is quite inefficient. On the other hand, the use of the method and device described in Japanese Patent Publication (unexamined) No. 271828 enables the above-mentioned operation to be performed automatically. However, it is essential in this method and device to clamp the package to cause loosening of the packaging material. Depending on the type of packaged items, loosening sometimes cannot be attained. An example is when hard objects, unable to be clamped sufficiently, are packaged. In such cases, it is impossible to cut and open the package using the above-mentioned method and device. Further, in performing this operation, a cutting blade is applied to the loosening of the packaging material. However, when the packaging material is not of strong material, the loosening of the packaging material tends to escape the cutting blade and the packaging material cannot be cut straight.

The purpose of the present invention is to enable automatic cutting and opening of any type of package regardless of the type of packaged items or the strength of the packaging material.

In order to attain this purpose, the present invention provides a space which is formed between the packaging material and the packaged items on the two mutually opposing planes of the rectangular package covered with packaging material. Thereafter, the packaging material is cut on the planes from one edge to the other in the direction of height or width. The packaging material is cut on the above-mentioned two planes from one of the two edges other than the edges passing the starting point and the finishing point of the cutting line. After a space is formed between the packaging material and the packaged items on the plane having two edges passing the ends of the above two cutting lines and adjacent to the above-mentioned two planes, the packaging material is cut so as to connect the two cutting lines. Thereafter, the packaging material is opened from each cut area on the three planes provided with cutting lines.

In this case, it is preferred that a backplate be inserted from a slit made by cutting the packaging material on the two mutually opposing planes of the rectangular package from one edge to the other. The packaging material on these planes is cut on top of the backplate, and in cutting the packaging material on the two mutually opposing planes, it is preferred that a space is formed between the packaging material and the packaged items by causing the packaging material to protrude using the tip of the backplate.

When the packages are of different sizes, it is preferred that the positions of the cutting lines to be provided on the two mutually opposing planes from one edge to the other are varied with respect to the datum plane to be provided with a cutting line and adjacent to the two planes.

The device of the present invention consists of a platform 1 on which a package covered with packaging material is placed. A member is provided to form a space between the packaging material and the packaged items on the two mutually opposing planes of the package on the platform 1, a pair of cutting blades 3, 3 cut the packaging material where a space is formed between the packaging material and the packaged items using the above member from one edge to the other. A pair of cutting blades 4, 4 are provided for rotating the packaging material from one of the two edges other than the edges passing the starting point and the finishing point of the two edges cut by the above pair of cutting blades 3, 3 to the above-mentioned cutting lines. The member for forming a space between the packaging material and the packaged items on the plane includes two edges passing the ends of the two cutting lines cut by the above pair of cutting blades 4, 4, a cutting blade 5 for cutting the packaging material so as to connect the two cutting lines on this plane, and a device to open the packaging material from each cut area on the three planes provided with cutting lines.

In this case, it is preferred that a pair of holders 6, 6 for holding a part of the two mutually opposing planes of the rectangular package placed on the platform 1 from both sides are provided on the side of the platform 1. It is also preferred that a pair of backplates 7, 7 are positioned for moving parallel to the two mutually opposing planes of the rectangular package placed on the platform 1 and can be inserted from slits on these two planes made by cutting the packaging material from one edge to the other.

When the rectangular packages to be placed on the platform 1 are different sizes, it is preferred that the platform 1 be positioned in relation to a cylinder so that the position of the platform 1 can be varied with respect to the plane to be provided with a cutting line and adjacent to the two planes of the package to be cut from one edge to the other according to the size of each package. It is also preferred that a pair of cutting blades 3, 3 are applied on the two mutually opposing planes in order to cut them from one edge to the other. A pair of holders 6, 6 are provided together with a pair of members for forming a space between the packaging material and the packaged items on the two planes cut from one edge to the other of the package. The members for forming a space are operatively connected to a cylinder so that their operating positions can all be varied according to the particular size of the rectangular packages as in the case of platform 1.

Furthermore, when the rectangular package is to be placed on the platform 1 by pressing it onto the platform 1, it is preferred that the backboard 8 for positioning the back plane of the package with respect to the platform 1 is located at the back of the platform 1. The backboard 8 is positioned in relation to a cylinder so that the position of the backboard 8 can be varied with respect to the plane to be provided with cutting lines and adjacent to the two mutually opposing planes cut from one edge to the other according to the size of the package to be placed on the platform 1. Especially when the package is pressed onto the platform 1 from the position where the plane to be provided with a cutting line and adjacent to the two planes cut from one edge to the other of the package to be placed on the platform 1 is aligned on the fixed position. It is preferred that the activation positions of the platform 1, a pair of cutting blades 3, 3, a pair of holders 6, 6, a pair of members for forming a space between the packaging material and the packaged items on the two planes of the package that are cut from one edge to the other, and the backboard 8 are operatively connected to the cylinder so that they can all be varied with respect to the datum plane of the package. The position of the members is chosen according to the particular depth of the package. Also in this case, the packages are preferably carried in a storage box to the prescribed position on the side of the platform 1.

A package cut by the method of the present invention is shown in FIG. 2 and FIG. 4. In FIG. 2, cutting lines $c_1$, $c_1$ are positioned longitudinally from one edge to the other on two mutually opposing planes $C_1$ and $C_1$. On each plane, a cutting line $c_6$ is provided between the above-mentioned cutting line $c_4$ and the edge $c_5$, which is one of two edges $c_1$ and $c_5$ other than edges $c_2$ and $c_3$ passing the starting point $s_1$ and the finishing point $s_2$ on the cutting line $c_1$, and on the plane $C_2$ adjacent to $C_1$, $C_1$ each having two edges $c_5$, $c_5$ passing points $s_3$, $s_3$ of the two cutting lines $c_6$, $c_6$, a cutting line $c_7$ connecting these two cutting lines is provided. Thus, when the packaging material on the three planes on which cutting lines $c_1$, $c_1$, $c_6$, $c_6$ and $c_7$ are provided is cut open at each cutting line, the package can be opened as shown in FIG. 3(*g*).

Also, when the two mutually opposing planes $C_1$ and $C_1$ are cut longitudinally from one edge to the other end, and a cutting line $c_7$ is provided on the plane $C_2$, spaces $c_8$ and $c_9$ are formed on the planes $C_1$, $C_2$ and $C_3$ between the packaging material and the packaged items as shown in FIG. 5 and FIG. 6, preventing damage to the packaged items even if the cutting blade is applied to the packaging material B.

In FIG. 4, on the other hand, cutting lines $c_{11}$ and $c_{11}$ are positioned horizontally from one edge to the other on two mutually opposing planes $C_1$ and $C_1$. On each plane, a cutting line $c_{61}$ is provided between the above-mentioned cutting line $c_{11}$ and the edge $c_2$, which is one of two edges $c_2$ and $c_3$ other than edges $c_4$ and $c_5$ passing the starting point $s_{11}$ and the finishing point $s_{21}$ on the cutting line $c_{11}$. On the plane $C_3$ adjacent to $C_1$, $C_1$ each plane includes two edges $C_2$ and $C_3$ passing points $s_{31}$, $s_{31}$ of the two cutting lines $c_{61}$, $c_{61}$, a cutting line $c_{71}$ is provided for connecting these two cutting lines. Thus, when the packaging material on the three planes $C_1$, $C_1$ and $C_3$ on which cutting lines $c_{11}$, $c_{11}$, $c_{61}$, $c_{61}$ and $c_{71}$ are provided is cut and opened at each cutting line, the package can be opened, as opposed to the case in FIG. 2, in a fashion wherein the package shown in FIG. 3(*g*) is in the horizontal position.

Also, when a cutting line $c_{11}$ is provided as shown in FIG. 4 and a space is formed between the packaging material and the packaged item on each of the two mutually opposing planes $C_1$, $C_1$, the packaging material would be like the one shown in FIG. 3(*d*) positioned horizontally.

In providing a cutting line $C_6$ on the two mutually opposing planes $C_1$, $C_1$, a ruler-like plate 7 may be inserted from the slit $c_1$ as shown in FIG. 3(*e*) and FIG. 5 to cut the packaging material on the top to avoid damaging the edges of the packaged items. A cutting line $c_{61}$ in FIG. 4 shall also be provided in the same fashion. In cutting the packaging material on the plane $C_2$ adjacent to the two mutually opposing planes $C_1$, $C_1$, formation of a space $c_9$ between the packaging material and the packaged items requires no extra member because the plate 7 presses the packaging material outward. Provision of a cutting line $c_{71}$ in FIG. 4 can yield the same effect by using this method.

When the size of the package varies as shown in FIGS. 17(*a*) to 17(*c*), the position of a cutting line $c_1$ to be provided on two mutually opposing planes $C_1$, $C_1$ could be varied with respect to the plane $C_2$ on which a cutting line $c_7$ is provided. A slit $c_1$ running from one edge to the other end on two mutually opposing planes $C_1$, $C_1$ of each package of a different size can be placed at different positions $l_1$, $l_2$, and $l_3$ with respect $C_2$ as shown in FIGS. 17(*a*) to 17(*c*). The same arrangement can be applied in the case shown in FIG. 4, wherein a ripped part $c_{11}$ running from one edge to the other on two planes $C_1$, $C_1$ on different-sized packages can be placed at different positions with respect to the one plane $C_3$.

Next, the functions of the cutting and opening device of the current invention will be explained.

A rectangular package C covered with packaging material B, as shown in FIG. 1, is placed on a platform 1, as shown in chain line in FIG. 19. On each side of the platform 1, a member for forming a space between the packaging material and the packaged items on two planes $C_1$, $C_1$ is provided as shown in FIG. 11. The pair of space-forming members is used on the two mutually opposing planes among the six planes of the package C placed on the platform 1. Thereafter, a space $c_8$, shown in FIG. 6, is formed between the packaging material B, B and the packaged items on the two planes $C_1$, $C_1$. At this time, when a pair of cutting blades 3, 3 is pressed and run on the packaging material on the two planes $C_1$, $C_1$, areas shown by $c_1$, $c_1$ on the two planes in FIG. 2 are cut. When a cutting line is provided in the direction shown by $c_{11}$ in FIG. 4 on the two mutually opposing planes $C_1$, $C_1$, a member for forming a space between the packaging material and the packaged items on the two planes $C_1$, $C_1$ is preferably placed in the latitudinal direction, in which case the pair of cutting blades 3, 3 to cut the packaging material shall also run in the latitudinal direction.

Next, a pair of cutting blades 4, 4, shown in FIG. 8, is applied in the latitudinal direction to the packaging material that is already cut from one edge to the other by the pair of cutting blades 3, 3. The packaging material cut from one edge to the other by the pair of cutting blades 4, 4 is then provided with a cutting line shown by $c_6$ in FIG. 2. When providing a cutting line shown by $c_{61}$ in FIG. 4, the pair of cutting blades 4, 4 are arranged perpendicularly, as opposed to the example shown in FIG. 4, and run vertically.

Next, a member for forming a space between the packaging material and the packaged items on the plane $C_2$ having two edges $c_5$, $c_5$ passing points $s_3$, $s_3$ of the two cutting lines $c_6$ and $c_6$, is activated. This forms a space $c_9$ between the packaging material B and the packaged material on this plane $C_2$ as shown in FIG. 5. Thereafter, a cutting blade 5, as shown in FIG. 8, is pressed on the packaging material on the plane $C_2$ and moves latitudinally. This provides the packaging material on the plane $C_2$ with a cutting line shown by $c_7$ in FIG. 2. When cutting a line shown by $c_{71}$ on the plane shown by $C_3$ in FIG. 4, the cutting blade 5 is arranged perpendicular, as opposed to the example in FIG. 4, and run latitudinally.

Thereafter, a device is activated to open the package along the cutting lines $c_1$, $c_1$, and $c_6$, $c_6$ and $c_7$ on the three planes $C_1$, $C_1$ and $C_2$, respectively. A package C' is cut as shown in FIG. 2 and may be opened as shown in FIG. 3(*g*). In the case of a package C'' cut as shown in FIG. 4, the package can be opened in the manner as shown in FIG. 3(*g*) in the horizontal position.

In cutting the packaging material of the package on the two mutually opposing planes $C_1$, $C_1$ either in the direction of height or width, the two planes $C_1$, $C_1$ can be held by a pair of holders 6, 6 to prevent unnecessary movement of the package in the process of cutting on the platform 1. When the package is cut as shown in FIG. 2, the pair of holders 6, 6 will operate on the two mutually opposing planes $C_1$, $C_1$ as shown in FIG. 3(*c*). When the package is cut as shown in FIG. 4, the pair of holders 6, 6 will operate on the two opposing planes $C_1$, $C_1$ in the fashion of FIG. 3(*c*) which is in the horizontal position.

In providing cutting lines $c_6$, $c_6$ on the two mutually opposing planes $C_1$, $C_1$, by moving the backplates 7, 7 placed on the side of the platform 1 parallel to these two planes $C_1$, $C_1$, the tips of the plates are inserted between the packaging material B and the packaged items through the slits $c_1$, $c_1$ that are made by cutting the packaging material on the two planes and the backplates can be used as underlays. When cutting as shown in FIG. 4, the backplates 7, 7 are arranged in the vertical direction, and they are moved upward to be inserted from the cut $c_{11}$ on the two planes $C_1$, $C_1$.

When different-sized rectangular packages are to be put on the platform 1, the activation positions of the platform 1, a pair of cutting blades 3, 3 applied on the two mutually opposing planes that are cut from one edge to the other, a pair of holders 6, 6, and a member for forming a space between the packaging material and the packaged items on the aforementioned two planes $C_1$, $C_1$, can be varied with respect to the planes $C_2$, $C_3$ adjacent to the two planes $C_1$, $C_1$ to be cut from one edge to the other. The cutting lines $c_7$, $c_{71}$ are provided according to the size of the package by operating each cylinder according to the size of the package. This will now be described with reference to FIGS. 17(*a*) to 17(*c*). When a plane $C_2$ to be provided with a cutting line $c_7$ is placed on one datum line L in the case of three packages of different sizes (depth, length) $L_1$ to $L_3$, if a pair of cutting blades 3, 3 for providing a cutting line $c_1$ on each of the two mutually opposing planes $C_1$ and $C_1$ are positioned at distances of $l_1$, $l_2$, and $l_3$, respectively, from each datum plane $C_2$ according to the size (depth, length) of each package. For example, a cutting line $c_1$ can be provided at distances of $l_1$, $l_2$ and $l_3$, respectively, from each datum plane $C_2$ on each of the two mutually opposing planes $C_1$, $C_1$. Also the operating positions of the pair of holders 6, 6 and the member for forming a space between the packaging material and the packaged items on the two planes $C_1$, $C_1$ can also be varied as in the case of the pair of cutting blades 3, 3, according to the size (depth, length) of the package.

When the rectangular package is placed onto the platform 1 by pressing it onto the platform 1 as shown in FIG. 10, the position of the backboard 8 located at the back of the platform 1 is varied with respect to the datum line L according to the size (depth, length) of the rectangular package as shown in FIG. 16(*a*) to 16 (*c*). In this way, the package to be placed on the platform 1 can be placed at a prescribed position according to its size (depth, length).

Especially, when the package is pressed onto the platform 1 from the same starting line shown by $l_o$ in FIG. 16(*a*) to 16(*c*), where the datum plane $C_2$ of each package of a different size (depth, length) is aligned. The activation positions, with respect to the package, of the platform 1, a pair of cutting blades 3, 3, a pair of holders 6, 6, a member for forming a space between the packaging material on the two planes $C_1$, $C_1$ of the package that are cut from one edge to the other and the packaged items, and the backboard 8, are selected appropriately according to the size (depth, length) of the package. This way, a package of any size (depth, length) can be provided with a cutting line of a prescribed direction on a prescribed plane of the rectangular package by using a single device as shown in FIG. 2. In this case, if rectangular packages are carried to the side of the platform 1 in a storage box, it is easier to align the datum plane $C_2$ of each package before placing on the platform 1 on the same starting line shown by $L_0$ in FIGS. 16(*a*) to 16(*c*).

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein:

FIGS. 3(*a*)–3(*h*) are diagonal views showing step-by-step operations from the cutting and opening of a package carried in by a conveyor to the taking out of blanks contained in the package;

DETAILED DESCRIPTION OF THE PREFERRED EMBODIMENTS

Embodiments of the present invention will now be described with reference to the accompanying drawings.

Figures 1, 2, 3A, 3B, 3C, 3D, 3E, 3F, 3G, 3H, 4, 5, 6:
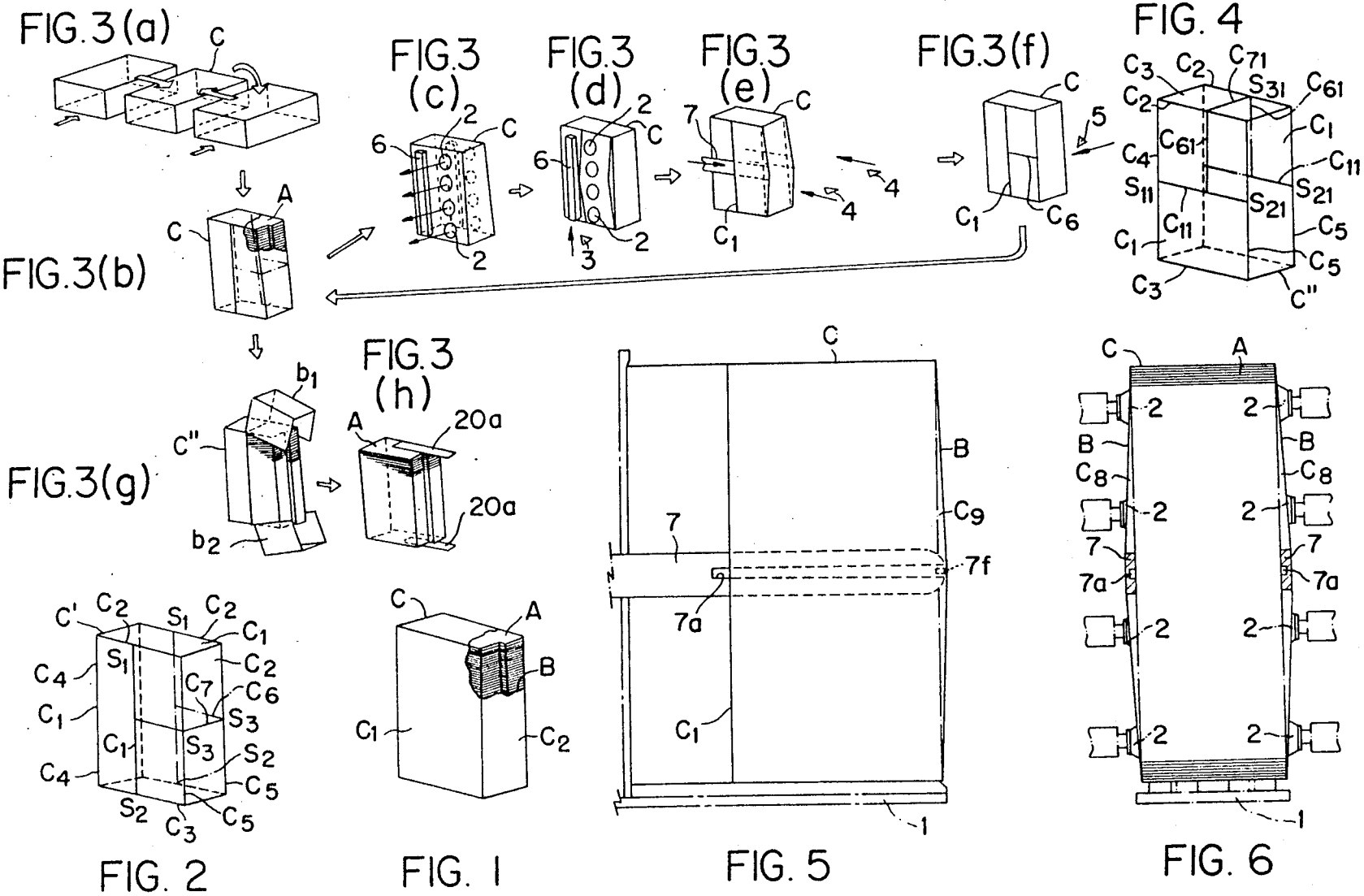
FIG. 1 is a diagonal view of an example of a rectangular package.
FIG. 2 is a diagonal view of cutting positions for the rectangular package.
FIG. 4 is a diagonal view showing a rectangular package cut at different positions from the package shown in FIG. 2.
FIG. 5 is an enlarged side view showing a condition where a package is cut from one edge to the other on the two mutually opposing planes of the packaging material in the direction of height and a backplate is inserted therein.
FIG. 6 is a vertical cross-sectional view.
Figures 17, 20, 21:
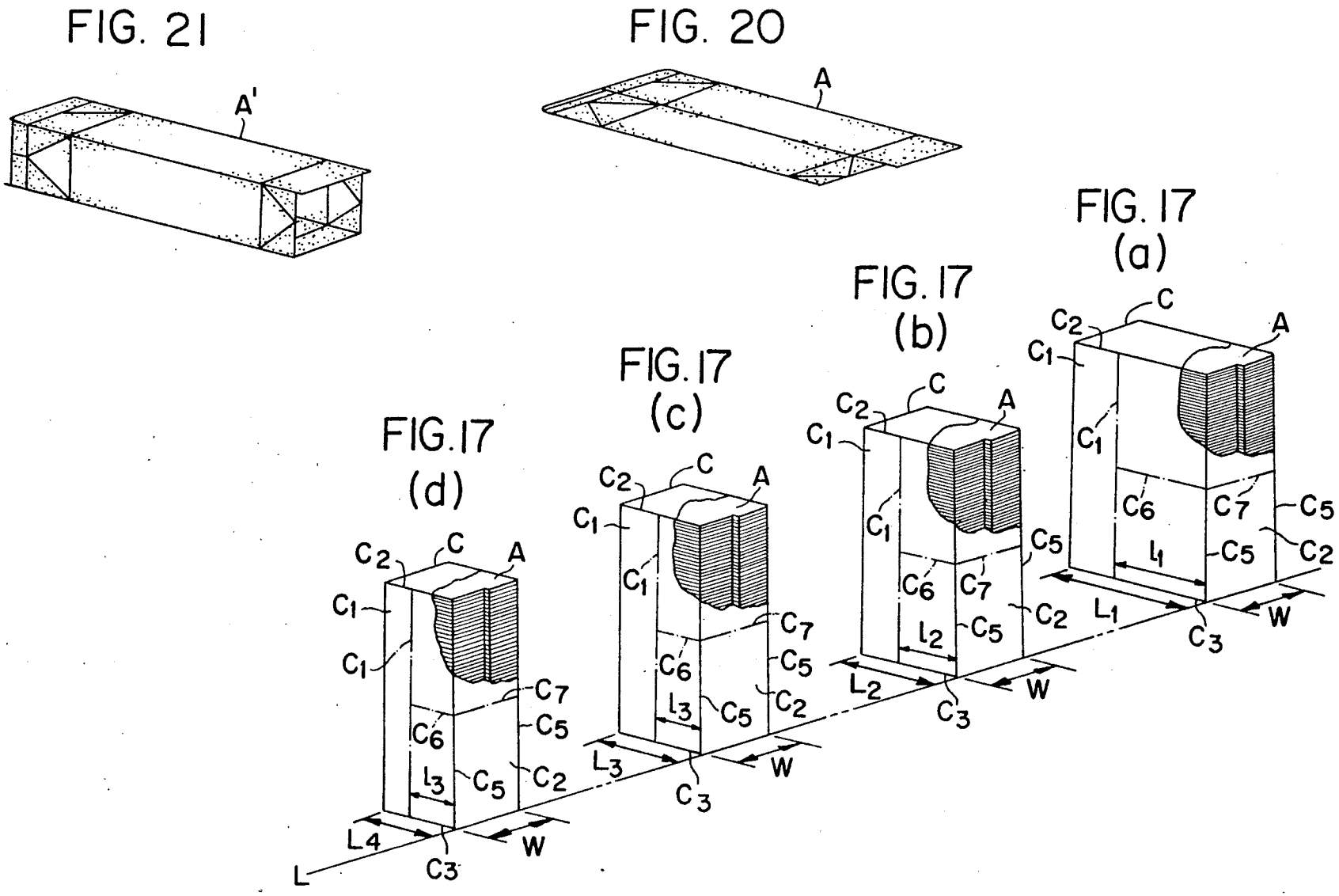
FIGS. 17(*a*)–17(*d*) ar e diagonal views showing conditions where a plane of each of the different-sized packages is positioned on the datum line.
FIG. 20 is a diagonal view of packaged flattened blanks.
FIG. 21 is a diagonal view where the above is raised to form a parallelepiped.

In one embodiment of the present invention, the packaged items are flattened packing container blanks, as shown in FIG. 20, wherein a case is shown in which multiple blanks A are bundled and covered with packaging material B on the outside as shown in FIG. 1. A rectangular package C is designed to be cut and opened.

In another embodiment, a case, shown in FIG. 1, includes packaging material B for the package C which is cut, as shown in FIG. 2, and opened, as shown in FIG. 3(*g*). The method of the present invention can also be applied to cutting and opening the rectangular package C as shown in FIG. 4.

Incidentally, the biggest difference between the cutting as shown in FIG. 2 and cutting as shown in FIG. 4 relates to the positioning of the package of FIG. 2, the cutting direction of the packaging material on the two mutually opposing planes of the rectangular package C from one edge to the other is in the vertical direction (in the direction of height). Whereas the package of FIG. 4, the package is in the horizontal direction (in the direction of width). In accordance with the positioning or direction at or in which a space between the package items and the packaging material B is formed, or the direction of cutting lines $c_6$, $c_6$ and $c_{61}$, $c_{61}$ on the two mutually opposing planes $C_1$, $C_1$, the position of the planes $C_2$, $C_3$ each incorporating two edges $c_5$, $c_5$, and $c_2$, $c_2$ that pass points $s_3$, $s_3$ and $s_{31}$, $s_{31}$ of $c_6$, $c_6$ and $c_{61}$, $c_{61}$, and the direction of cutting lines $c_7$, $c_7$ provided on the planes are different between when cutting as shown in FIG. 2 and when cutting as shown in FIG. 4. However, the cut condition shown in FIG. 4 is in the horizontal position of the condition shown in FIG. 2, and the cut conditions are essentially the same. The open condition after cutting, as shown in FIG. 4, is like the condition in FIG. 3(*g*) in the horizontal position, and they are essentially the same. In providing cutting lines $c_6$, $c_6$ and $c_{61}$, $c_{61}$, a backplate 7 is inserted from slits $c_1$, $c_1$ and $c_{11}$, $c_{11}$, in which the only difference between when cutting as shown in FIG. 2 and when cutting as shown in FIG. 4 is the insertion direction. The idea of inserting the backplate 7 from a cut area is the same.

On the other hand, while the device shown in the embodiment is used to cut the rectangular package as shown in FIG. 3(*b*) and FIG. 2 via a process shown in FIGS. 3(*c*) to 3(*f*) and open a package C′ as shown in FIG. 3(*g*) after cutting, the device used to cut and open a package C″ as shown in FIG. 4 after cutting has exactly the same functions as the former except the arrangement direction, running direction or operating direction of the cutting blade and other components to cut the packaging material B on the prescribed positions.

Figure 8:
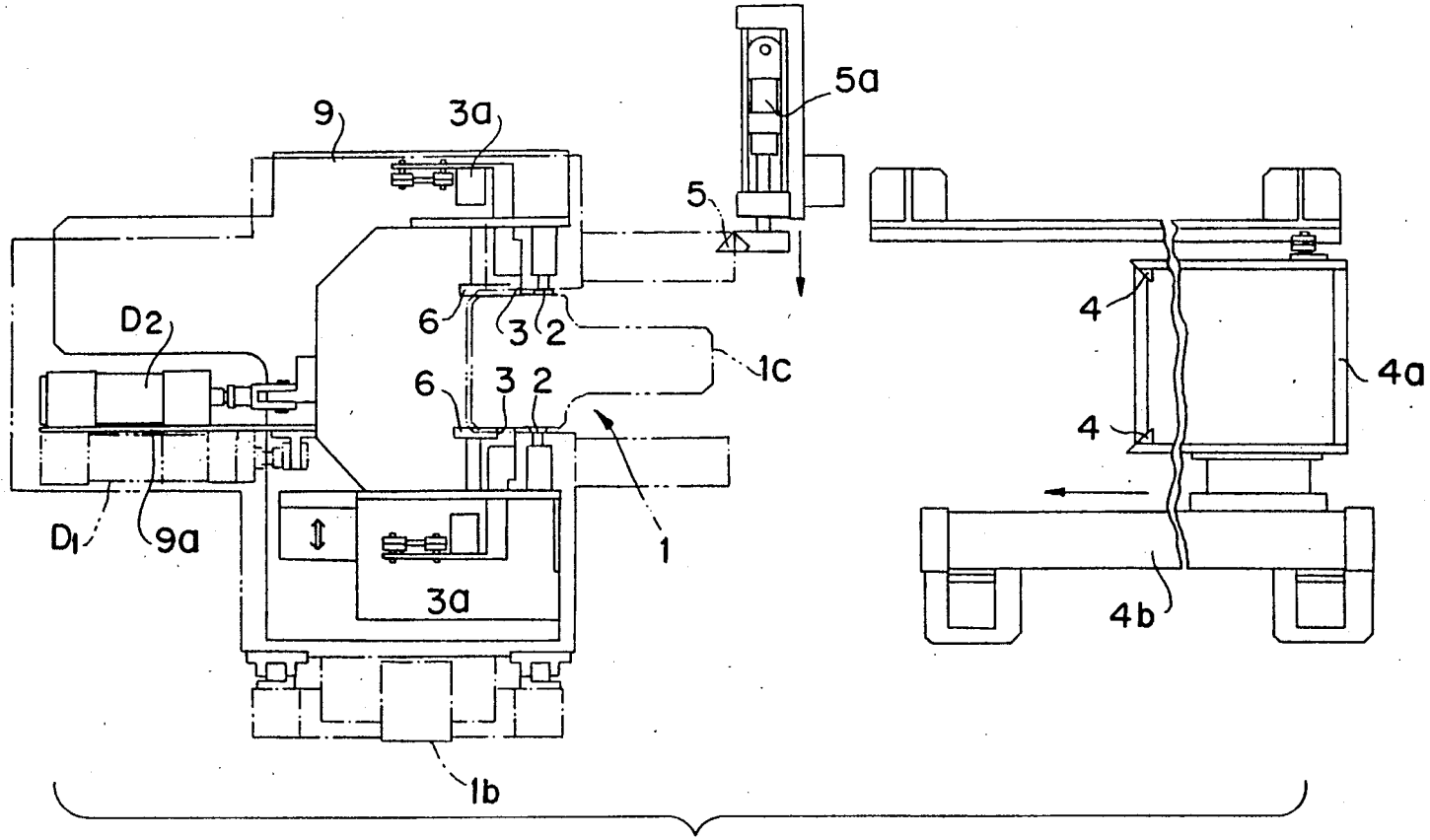
FIG. 8 is a plan view roughly showing an entire view of the package cutting and opening device.
Figure 11:
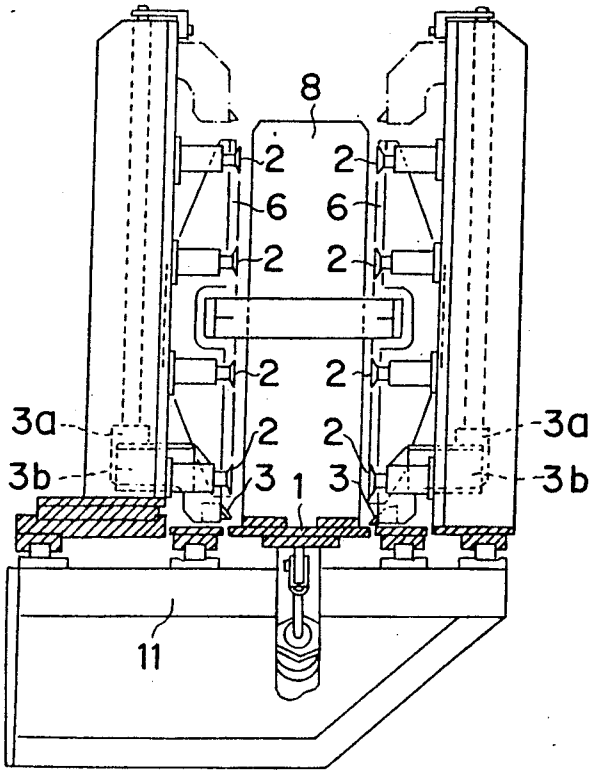
FIG. 11 is a front view of the package cutting and opening device.
Figure 10:
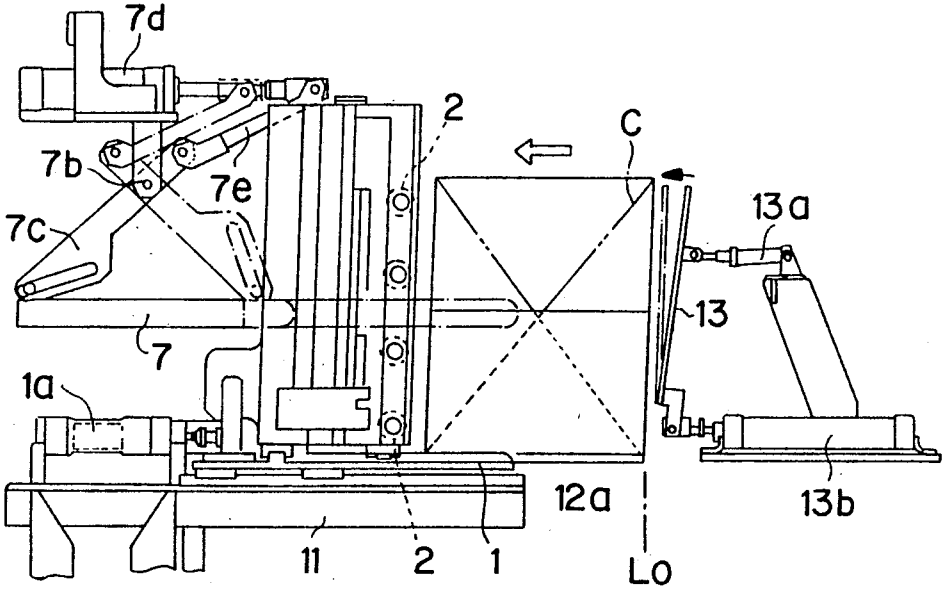
FIG. 10 is a side view of the package cutting and opening device showing a condition where a storage box is placed in front of the platform, which is a part of the package cutting and opening device, and a pusher is located further in front of the storage box.

More detailed description of the embodiments will be as follows. A platform 1 and the package C is placed on the platform 1 where the packaging material B is cut and opened. The packaging material B can be cut by applying a thin cutting blade on the packaging material B and move it. In order to avoid contact of the cutting blade with the packaged blanks A, a space is formed between the packaging material B and the blanks A. As a means to form a space between the packaging material B and the blanks A on the two mutually opposing planes $C_1$, $C_1$, the embodiment shows a case in which suction pads 2 are used as shown in FIG. 8, FIG. 10 and FIG. 11. Also, in providing a cutting line $c_7$ on plane $C_2$ of the rectangular package C, a means similar to the suction pads could be used to form a space between the packaging material B and the blanks A. However, in the embodiment illustrated, a case is shown as an example in which the backplate 7 inserted from slits $c_1$, $c_1$ is used to permit the packaging material B to protrude outward (explained in detail later).

The packaging material B could be cut as mentioned above by pressing a thin cutting blade on the packaging material B and moving the cutting blade. In addition, a rotating type cutting blade can also be used. The cutting blade pressing positions in the case of this embodiment are on a symmetrical vertical line shown by $c_1$ on the two mutually opposing planes $C_1$, $C_1$ of the package C as shown in FIG. 2. In addition, the cutting blade pressing positions are on horizontal lines shown by $c_6$ that connect the aforementioned cutting line $c_1$ with an edge $c_5$, which is one of the two edges $c_4$, $c_5$ other than the two edges $c_2$, $c_3$ that pass the starting point $s_1$ and the finishing point $s_2$ of the cutting line $c_1$ in FIG. 2. Further, the cutting blade pressing positions are on a horizontal line shown by $c_7$ that connects $c_6$ and $c_6$ on the plane $C_2$ in FIG. 2. The cutting blades to cut the areas are located on sides of the package C placed on the platform 1. The cutting blades 3 for providing cutting lines on the packaging material B as shown by $c_1$ in FIG. 2 vertically (heightwise) from one edge to the other on the two mutually opposing planes $C_1$, $C_1$ on the rectangular package C are shown in FIGS. 8 and 11. The cutting blades 4 for providing cutting lines $c_6$ in FIG. 2 are shown in FIG. 8. Further, cutting blade 5 for providing a cutting line $c_7$ in FIG. 2 is shown in FIG. 8.

As a means to move a left and right pair of cutting blade 3, 3 in FIG. 22, cylinders 3*a*, 3*a* are placed on the sides of platform 1. The left and right pair of cutting blades 3, 3 are pressed on the package C on the platform 1 and moved from the solid line in FIG. 11 to the chain line so that areas shown by $c_1$, $c_1$ on the packaging material B of the package C in FIG. 2 can be cut. In addition to the cylinders 3*a*, cylinders 3*b* are provided to allow the cutting blades 3 to move in the left and right direction in FIG. Il. The cylinders 3*b* are used to tentatively place the cutting blades 3 at the back of the platform 1 to a position on the left and right of FIG. 11 and move the cutting blades 3 to the solid line in FIG. 11 when cutting the packaging material B. The cutting blades 3, after the cutting operation is finished, are lowered by the cylinders 3*a* that are withdrawn by the cylinders 3*b*.

The top and bottom cutting blades 4 are arranged to appear symmetrically in FIG. 8, by moving forward from the solid line in FIG. 8 toward the platform 1 on the left, the cutting blades 4 can cut areas shown by $C_6$, $C_6$ in FIG. 2 on the packaging material B of the package C. As a means to move the pair of cutting blades 4, 4 closer to the platform 1 as shown above or move them backward to the solid line in FIG. 8 after cutting the packaging material B, a case is shown in the embodiment as an example in which a frame 4*a* mounted with the pair of cutting blades 4, 4 can be moved in the direction of left and right in FIG. 8 by the cylinders 4*b*.

On the other hand, the cutting blade 5 is located as shown in FIG. 8 and by moving forward from the solid line, it can cut an area shown by $c_7$ in FIG. 2 on the packaging material B of the package C placed on the platform 1. As a means to move the cutting blade 5 forward or to move it backward to the solid line in FIG. 8 after cutting the packaging material B, a cylinder 5*a* is provided to move the cutting blade 5 vertically in FIG. 8.

In performing the above-mentioned cuttings, the package C on the platform 1 is stationary. Specifically, in the embodiment, a pair of holders 6, 6 that can press the two mutually opposing planes $C_1$, $C_1$ are arranged as shown in FIGS. 8 and 11. When the pair of holders 6, 6, illustrated on the left and right in FIG. 11, are in the solid line position, they hold the package C on the platform 1. When the pair of suction pads 2, 2, illustrated on the left and right in FIG. 11, are slightly withdrawn from the solid line as shown by arrows in FIG. 3(*c*) after performing suction, the areas on the packaging material B on the two vertical planes $C_1$, $C_1$ of the package C not pressed by the pair of holders 6, 6 are pulled outward as shown in FIG. 3(*d*). A space $C_8$ is formed between the package and the rim edges of the blank A. In this way, the packaged items A are not damaged when the aforementioned cutting blades 3 are pressed on the packaging material B and moved on the packaged items. Since the package C is held by the pair of holders 6, 6, the cutting position does not move.

The area $c_1$ cut by the cutting blades 3 is in the open condition and is ingeniously utilized in the embodiment. Specifically, ruler-like backplates are inserted through the areas as shown in FIG. 3(*e*). Each backplate 7 can be placed in the space part way between the packaging material B pulled outward by the suction pads 2, 2 and the packaged blanks A as shown in FIG. 6. In this way, by using the backplates 7 as underlays when cutting the areas shown by $c_6$, $c_6$ in FIG. 2 with cutting blades 4, rim edges of the packaged blanks A are not damaged. Also by forming a longitudinal hollow 7*a* on the outside of each backplate 7 as shown in FIGS. 5 and 6, and arranging the tip of the aforementioned cutting blade 4 to be positioned in the hollow 7*a* when it moved horizontally and cuts the packaging material B, not only the tip of the blade but also the cutting position of the packaging material B is held so as to not deviate.

The tips of the backplates 7 that are inserted through the cut areas $c_1$ of the package C push the packaging material B on the other perpendicular plane $C_2$ in the package C outward as shown in FIGS. 3(*e*) and 5. This forms a space $c_9$ between the packaging material B and the packaged blanks A. In this way, when cutting the packaging material B on the plane $C_2$ using the cutting blade 5, the rim edges of the packaged blanks A are not damaged. Also by forming a hollow 7*f* at the tip of the backplate 7 as shown in FIG. 5, and arranging the tip of the aforementioned cutting blade 5 to be positioned in the hollow 7*f* when it moves horizontally and cuts the packaging material B, not only the tip of the blade but also the cutting position of the packaging material B is held so as to not deviate.

In inserting backplates 7 through the slits $c_1$ cut by the cutting blades 3 as shown in FIG. 3(*e*) and 5 on the plane $C_1$ on the package C, one end of a lever 7*c* that can be oscillated from a pivot 7*b* as shown in FIG. 10 can be linked to the backplate 7, and the other end of the lever 7*c* and the tip of the rod of the cylinder 7*d* can be linked with a lever 7*e*. When the rod of the cylinder 7*d* withdraws from the solid line in FIG. 10, lever 7*c* oscillates via lever 7*e* from pivot 7*b* as shown by chain line in FIG. 10. In this way, the backplate 7 shown by solid line can moved forward to the right in FIG. 10 as shown by chain line in FIG. 10, and the backplate 7 can be gradually inserted into the package C from the tip.

Figure 18:
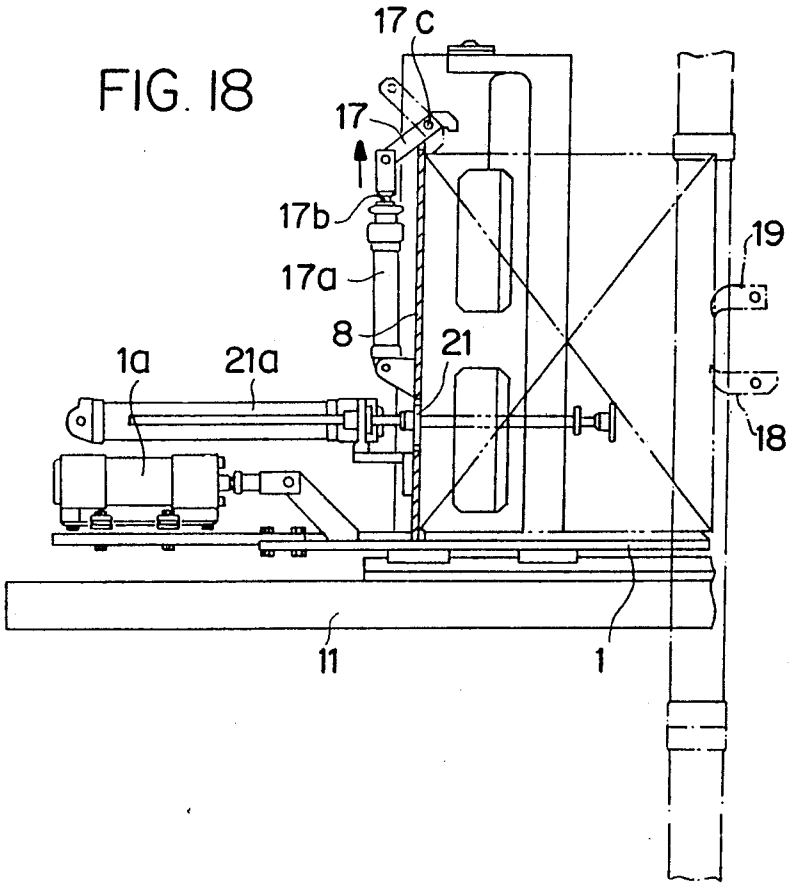
FIG. 18 is a side view showing a condition where an opening device of a cut package is combined with a cutting device.

For the above-mentioned cutting operations, a backboard 8 is provided at the back of the platform 1 and at the left of FIG. 18 in order to determine the position of the package C on the platform 1. During the above operations, the backboard 8 is positioned to contact the back plane $C_4$ shown in FIG. 2 of the package C.

Figure 9:
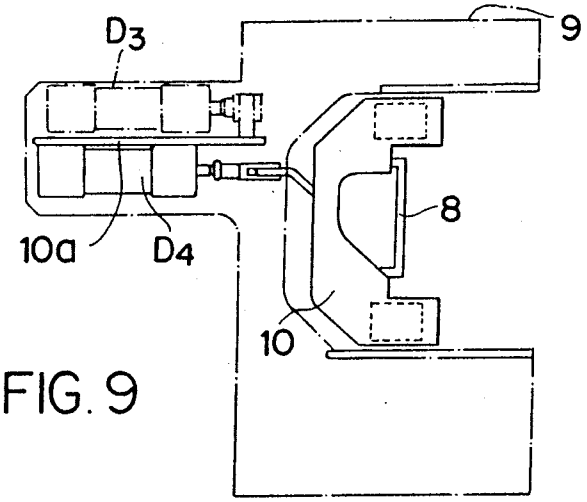
FIG. 9 is a plan view showing the relationship between the two platforms located above the platform, which is a part of the package cutting and opening device.
Figures 16A, 16B, 16C, 16D:
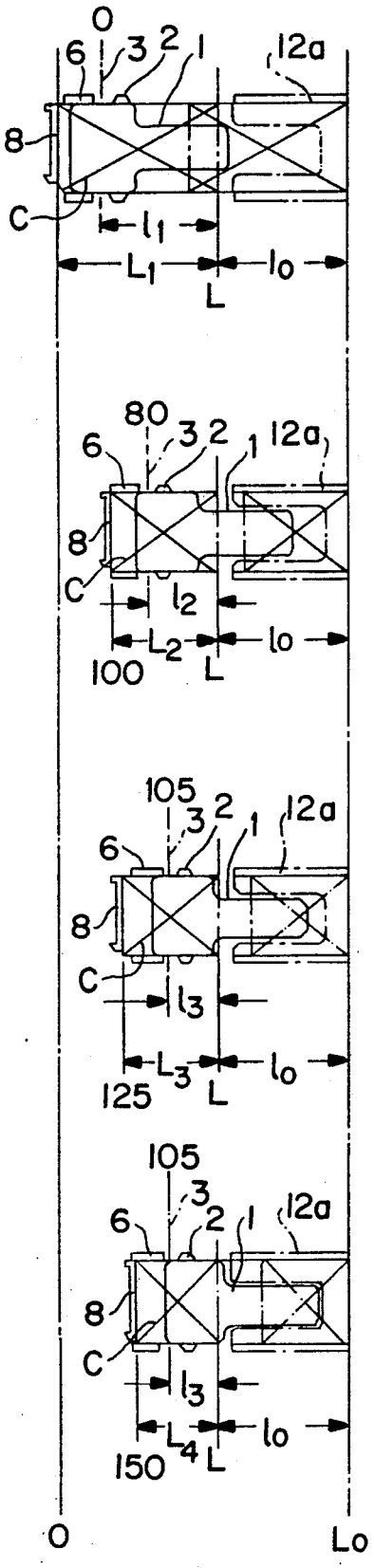
FIGS. 16(*a*)–16(*d*) are plan views showing the relationship between the storage box positioned at the prescribed position and packages of different sizes and the platform contained in it, a pair of suction pads, a pair of cutting blades, a pair of holders, and the backplate.

The holders 6 and the suction pads 2 are located on another platform 9 above the platform 1 as shown in FIG. 8. The backboard 8 is located on another platform 10 above the platform 9. The platform 1 is able to move with respect to the frame 11 by a cylinder 1*a*. The platform 9 is able to move with respect to the platform 1 by another cylinder $D_1$ shown by chain line in FIG. 8 mounted on the platform 1 and a cylinder $D_2$ mounted on the side of platform 9. The platform 10 is able to move with respect to the platform 9 by another cylinder $D_3$ shown by chain line in FIG. 9 mounted on the platform 9 and a cylinder $D_4$ mounted on the side of platform 10, respectively. Moving distances of platforms 1, 9 and 10 and the inter-platform positional relationships can be freely altered by operating all of the cylinders or only some of the cylinders as necessary. For example, in providing cutting lines $c_1$, $c_1$ on the two mutually opposing planes $C_1$, $C_1$ of four packages of different sizes (depth, length) as shown by $L_1$–$L_4$ in FIGS. 17(*a*)–17(*d*), each package is placed on the platform 1 so that the plane $C_2$ on which a cutting line $c_7$ is to be provided is aligned on the one datum line L. In this case, in order for the package to at least be placed on the platform 1, the position of the platform 1 has to be varied according to the length of the package as shown in FIGS. 16(*a*)–16(*d*). In this embodiment, the cylinder shown by 1*a* in FIGS. 10 and 18 performs this operation. In other words, by activating the cylinder 1*a* to move the platform 1 for a prescribed distance in the left and right direction of FIG. 18 with respect to the frame 11, the portion of the platform 1 can be varied according to the length of the package to be cut.

When cutting a package of a length of $L_1$, the cutting blades 3, 3 shall be located at a distance of $l_1$ from the datum line L. In addition, when cutting a package of a length of $L_2$, the cutting blades 3, 3 shall be located at a distance of a length of $l_2$ from the datum line L. Similarly, when cutting packages of lengths of $L_3$ and $L_4$, the cutting blades 3, 3 shall be located at a distance of $l_3$ from the datum line L. At the same time, the positions of the pair of suction pads 2, 2 and the pair of holders 6, 6 that activate on the two mutually opposing planes $C_1$, $C_1$ of each package shall be varied and the backboard 8 shall be located at distances $L_1$, $L_2$, $L_3$ and $L_4$, respectively, from the datum line L. For doing that, all of the above-mentioned four cylinders $D_1$–$D_4$ are activated or only some of the cylinders are activated leaving others inactive as necessary. For example, when cutting packaging material B on the two mutually opposing planes $C_1$, $C_1$ of a package of length $L_1$, a pair of cutting blades 3, 3 and a pair of holders 6, 6 are positioned so that the area at a distance of $l_1$ from the datum line L can be cut. In this case, the backboard 8 is positioned so that it contacts the back plane of the package of length $L_1$, the plane opposite to the datum line L, i.e., the left end plane of FIGS. 16(*a*)–16(*d*). Similarly, in the case of packages of lengths $L_2$, $L_3$ and $L_4$, areas only 80 mm or 105 mm closer from the cutting positions of the packages to the datum line L are cut as shown in FIGS. 16(*b*)–16(*d*). In this case, if the backboard 8 is assumed to contact the back plane of each package at positions 100 mm, 125 mm or 150 mm closer to the datum line L as compared to the case handling a package of length $L_1$, at least one of the four cylinders $D_1$–$D_4$ could be moved by an amount shown in Table 1 to cut prescribed areas of packages of lengths $L_2$, $L_3$ and $L_4$. In this case, each backboard is made to contact the back plane of each package.

TABLE 1

| | | (unit: mm) | | | |
|---|---|---|---|---|---|
| backboard | (8) | 0 | 100 | 125 | 105 |
| cutting blade | (3) | 0 | 80 | 105 | 105 |
| cylinder | $D_4$ | 0 | 0 | 0 | 25 |
| " | $D_3$ | 0 | 20 | 20 | 20 |
| " | $D_2$ | 0 | 0 | 25 | 25 |
| " | $D_1$ | 0 | 80 | 80 | 80 |

TABLE 1-continued

| | | (unit: mm) | | |
|---|---|---|---|---|
| packages: | (length $L_1$) | ($L_2$) | ($L_3$) | ($L_4$) |

More detailed descriptions about the cutting a package of the length $L_4$ is set forth as follows. As shown in FIG. 8, the cylinder $D_1$ mounted on the platform 1 is moved to the right side in FIG. 8 for a stroke of 80 mm, the dimensions of the solid line. Please note that the numbers appearing hereafter are all actual dimensions. Incidentally, the cylinder $D_1$ is mounted on the platform 1 as shown by chain line in FIG. 8. The operating piston of the cylinder is linked with the perpendicular plate 9*a*, shown by solid line on the platform 9 above the platform 1. Therefore, by moving the cylinder $D_1$ for a stroke of 80 mm, the platform 9 will also move for 80 mm to the right side. When the cylinder $D_1$ is activated, cylinder $D_2$ is also moved for 25 mm simultaneously as shown in Table 1, moving the platform 9 for 25 mm further toward the right with respect to platform 1. This way, the platform 9 will move for 80 +25 =105 mm toward the right with respect to platform 1. The fact that the platform 9 moves to the right for 105 mm from the initial position in FIG. 8 means that the pair of cutting blades 3, 3 mounted on the platform 9 are moved for 105 mm to the right from the fixed position where a package of length $L_1$ is cut. If the pair of cutting blades 3, 3 are pressed and moved on a package of length $L_4$, the area 105 mm closer to the datum line L from the cutting position of the package of the length $L_1$ can be cut. In this case, the pair of suction pads, and the pair of holders 6 mounted on the platform 9 are also moved according to the movement of the pair of cutting blades 3, 3, respectively.

In the above-mentioned case, the cylinder $D_3$ and the cylinder $D_4$ are moved for 20 mm and 25 mm, respectively, to the right in FIG. 8, as shown in Table 1. Incidentally, the cylinder $D_3$ is mounted on the platform 9 as shown by chain line in FIG. 9, and the operating piston of the cylinder is linked with a perpendicular plate 10*a*, solid line, of the platform 10 above the platform 9. Therefore, by moving the cylinder $D_3$ for a stroke of 20 mm, the platform 9 that is moved for 105 mm with respect to the platform 1 as described earlier, moves for 105 +20 =125 mm to the right in FIG. 9. When the cylinder $D_3$ is moved for a stroke of 20 mm, the cylinder $D_4$ is simultaneously moved for 25 mm as shown in Table 1, moving the platform 10 for 25 mm to the right in FIG. 9 with respect to the platform 9. In this way, the platform 10 will move for 125 +25 =150 mm to the right with respect to the platform 1. The fact that the platform 10 moves for 150 mm to the right from the initial position in FIG. 9 means that the backboard 8 mounted on the platform 10 is moved for 150 mm to the right from the fixed position where a package of length $L_1$ is handled. Further, the backboard 8 contacts the back side of the package of the length $L_4$, the plane opposite to the datum line L, the extreme left plane of FIGS. 16(*a*)–16(*d*) to position the package. When handling a package of length $L_2$, cylinders $D_1$ and $D_3$ of the four cylinders are activated, and the other two cylinders $D_2$ and $D_4$ are stopped. When handling a package of length $L_3$, three cylinders $D_1$–$D_3$ of the four cylinders are activated, and the remaining cylinder $D_4$ is not activated. This allows packages of lengths $L_2$ and $L_3$ to be cut at desired positions with a pair of cutting blades 3, 3. In this case, the backboard 8 can be made to contact the back plane of each package.

As described above, by using multiple cylinders and having all of the cylinders or only some of the cylinders activated, a pair of cutting blades 3, 3, a pair of suction pads 2, 2, a pair of holders 6, 6 and a backboard 8 can be positioned at desired places.

In this manner, even in the case in which the lengths of blanks A and the package C bundled with packaging material B differ as shown in FIGS. 17(*a*)–17(*d*), by positioning one plane $C_2$ of each package prior to loading on the platform 1 always at the same position, in other words, on the same datum line L, for example, positions of the one platform 1, the cutting blades 3, the suction pads, the holders 6 and backboard 8, can all be altered according to the lengths of packages. This means that even in the case in which packages to be cut are of different lengths, the platform 1 that support the packages will go to the prescribed position to meet the packages. The prescribed positions on the two mutually opposing planes of each package can be vertically cut with cutting blades 3, and even when handling packages of different lengths, packaging material B can be vertically cut at prescribed positions for each package.

Figure 19:
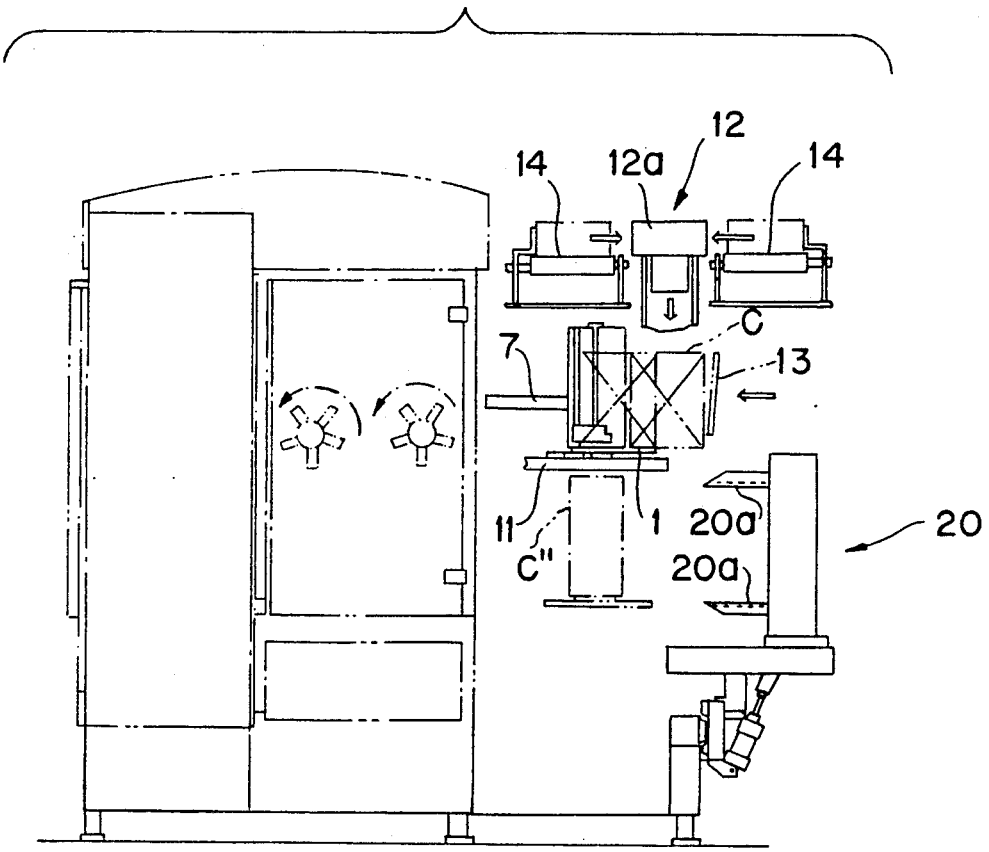
FIG. 19 is a side view showing the relationship between the package cutting and opening device of the current invention, the conveyor for carrying the package, the transferring device for transferring the package carried in by the conveyor to the cutting and opening device, and the robot for taking out the packaged items contained in the cut and opened package.

The packaging material B of the package C on the platform 1 can be cut as described above. In this case, the platform 1 is at the position of the solid line in FIG. 19, which is the cutting line. In the embodiment, platform 1 is lowered as shown in FIG. 19 by chain line, and the cut packaging material B is opened at this position shown by chain line. This is very convenient because the spaces above and below can be used to their maximum capacities. In order to lower the platform 1 from the solid line position in FIG. 19, as shown by chain line, a cylinder shown by 16 in FIG. 8 can be used to lower the entire platform 1 with a frame 11.

Figure 15:
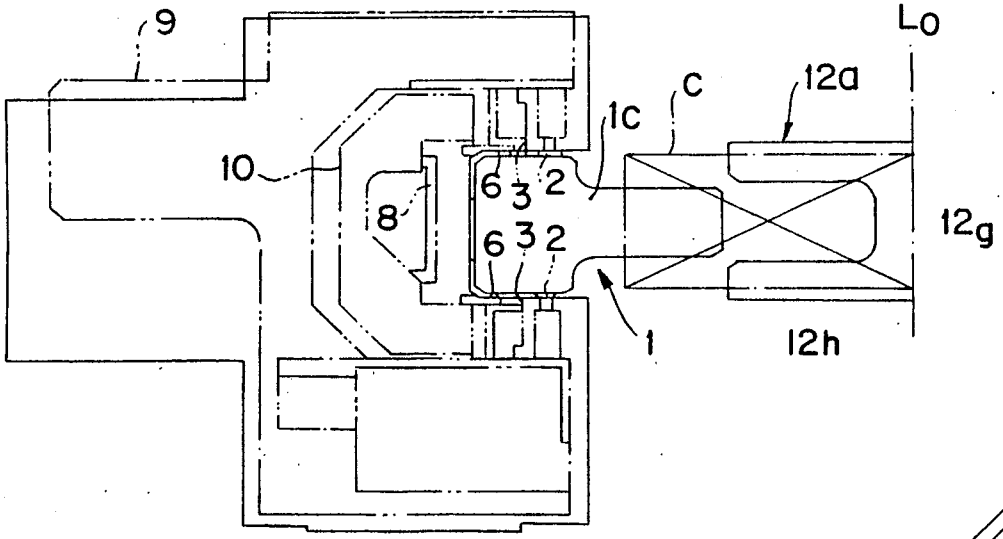
FIG. 15 is a plan view showing the relationship between the platform, the other two platforms located above the platform and the storage box lowered to the prescribed position.

Incidentally, when providing cutting lines $c_1$, $c_1$ on the two mutually opposing planes $C_1$, $C_1$ of packages of different sizes (depth, length) as shown by $L_1$ to $L_4$ in FIGS. 17(*a*)–17(*d*), in order to place each package on the platform 1 so that the plane $C_2$ to be provided with a cutting line $c_7$ is aligned on one datum line L, all packages, regardless of their sizes (depth, length), can be positioned on the datum line shown by $L_0$. Each package is pressed into the platform 1 therefrom. In the embodiment, a transferring device 12, having a right end with respect to the platform 1 being on the datum line $L_0$, is placed beside the platform 1 as shown in FIGS. 10 and 15. The package C is transferred to the platform 1 from the transferring device 12 by a pusher 13 shown by 13 in FIGS. 10 and 19. By aligning the right end of both the transferring device 12 and the package stored herein on the datum line shown by $L_0$ in FIGS. 10, 15 and 16, and by making the stroke of the pusher 13 constant, each package can be placed on the platform 1 so that each plane $C_2$ to be provided with a cutting line $c_7$ is positioned on one datum line L.

Figure 14:
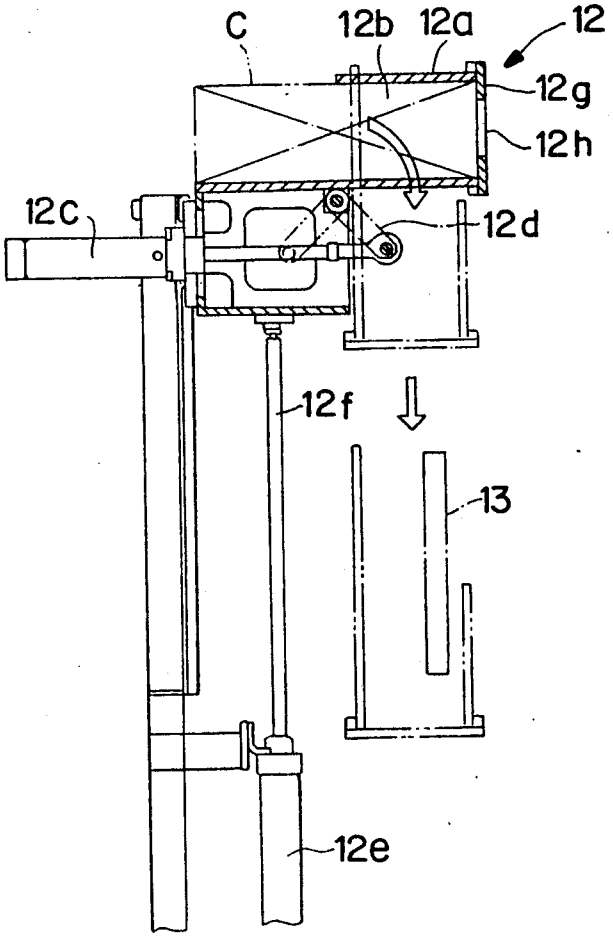
FIG. 14 is a vertical cross section of FIG. 13 as taken along line XIV—XIV.
Figure 13:
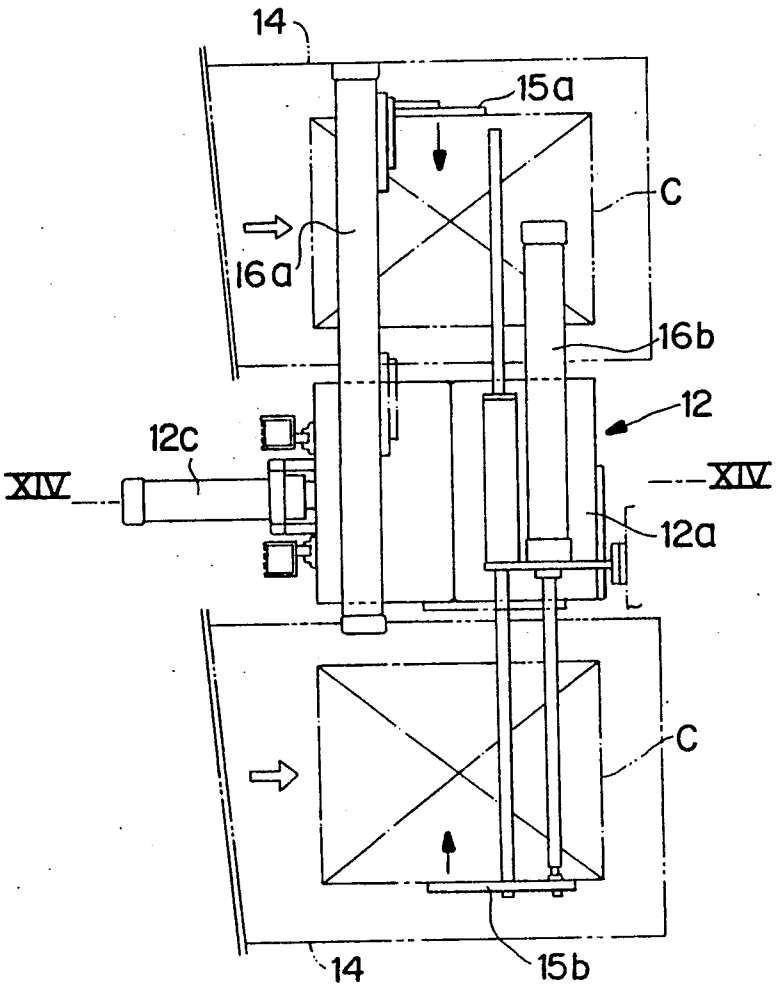
FIG. 13 is an enlarged plan view showing the relationship between the package transferring device and the pusher located above it and used to press the rectangular package into the storage box of the transferring device.

When providing cutting lines $c_1$, $c_1$ on the two mutually opposing planes $C_1$, $C_1$ of the package C, the package C can be stored in the transferring device 12 positioned at a fixed distance from the platform 1. However, in the case of the embodiment, the package C is carried in by two conveyors 14, 14 as shown in FIGS. 13 and 19. The package C is stored in the transferring device 12 by pushing into the transferring device 12 positioned between both conveyors 14, 14 alternately or from one of them, and the transferring device 12 is rotated thereafter as shown in FIG. 14 by single-dotted chain line and is lowered to the fixed position beside the platform 1 as shown in double-dotted chain line. In order to supply package C to the two conveyors 14, 14, a device, not illustrated, that can selectively lift and supply a package placed on the palette to the two conveyors 14, 14, can be installed to perform this function automatically.

The transferring device 12 shown in the embodiment is equipped with a storage box 12*a* with an L-shaped cross section as shown in FIG. 14. The package C is carried in by the two conveyors 14, 14 and is pressed into the storage box 12*a* either alternately or continuously from either one of the two openings 12*b* shown in left and right of FIG. 13. In order to press the package C into the storage box 12*a*, pushers 15*a*, 15*b* are arranged above the two conveyors 14, 14 as shown in FIG. 13. The pusher 15*a* and pusher 15*b* are alternately transferred from the solid line position in FIG. 13 as shown by chain line by cylinder 16*a* and cylinder 16*b*, respectively. In order to store the package C into the storage box 12*a* continuously from either one of the two openings 12*b*, only one of the two cylinders 16*a*, 16*b* is activated and the other is left inactive. The storage box 12*a* can be rotated from the solid line position in FIG. 14 as shown by the single-dotted chain line, and can be further lowered to the prescribed position as shown by the double-dotted chain line in FIG. 14 while maintaining its position. In order to rotate the storage box 12*a* from the solid line position in FIG. 14, as shown by the single-dotted chain line, a method can be used, for example, in which the storage box 12*a* and the tip of the rod of cylinder 12*c* are connected by the lever 12*d*. When the rod of the cylinder 12*c* is withdrawn from the solid line position in FIG. 14, storage box 12*a* that was in the horizontal position via the lever 12*d* rotates for 90° as shown by the single-dotted chain line in FIG. 14. Further, in order to lower the storage box 12*a* to the prescribed position maintaining its position as shown by the double-dotted chain line in FIG. 14, rod 12*f* of the vertically activatable cylinder 12*e*, for example, can be directly connected to the storage box 12*a*. In this way, the package C carried in from the two conveyors 14, 14 can be pressed into the storage box 12*a* either alternately or consecutively, and lowered to the position shown by the double-dotted chain line in FIG. 24 after rotating the position of the storage box by 90°.

At the lowermost position of the transferring device 23 a pusher 23 is installed as illustrated in FIGS. 10, 14 and 19. The pusher 13, as described above, will move for only a certain stroke from one of the two openings 12*b* of the storage box 12*a*, i.e., from the right hand side to the left hand side in FIG. 10. This allows the package inside the storage box 12*a* to be pushed out to the prescribed position. In other words, as described above, the storage box 12*a* and the package C stored inside are lowered so that their right ends are on the datum line $L_0$ in FIGS. 10, 15 and 16. With a movement of the pusher 13 of a prescribed stroke of $l_o$, the package C can be placed on the platform 1 so that the right end of the package C is on the datum line shown by L in FIGS. 16(*a*)–16(*d*). The pusher 13 is slightly titled until the storage box 12*a* is lowered as shown in FIG. 20. However, before the end of the lowering of the storage box 12*a*, the pusher 13 becomes vertical as shown by chain line in FIG. 10 by cylinder 13*a* to work as a guide. The pusher 13 is moved by another cylinder 13*b* to the left in FIG. 1 for a certain stroke $l_0$ maintaining the position of the pusher 13 to push the package C inside the storage box 12*a* out to the prescribed position, on the line shown by L in FIGS. 16(*a*)–16(*d*), and place it onto the platform 1.

The bottom part 12*g* of the storage box 12*a* for lowering the package C to the prescribed position is partially cut out as shown by 12*h* in FIG. 15. This is to avoid mutual conflict of the platform and the storage box 12*a* that is lowered to the prescribed position when handling packages of different sizes (depth, length). For example, if the platform 1 is set to be positioned as shown in FIG. 16(*a*) when handling a package of length $L_1$, handling of packages of lengths, $L_2$, $L_3$ and $L_4$ that are shorter than $L_1$ requires that the cylinder 1*a*, as shown in FIG. 18, is activated as above described and the position of platform 1 with respect to the storage box 12*a* is varied according to the length of the package. In this case, the portion 1*c* at the front of the platform 1 is engaged in the cut-off part 12*h* of the storage box 12*a* and is constructed so as to not conflict with each other.

It is already mentioned that the package C is placed on the platform 1 and the packaging material B is cut and opened thereon. Next, an example of a device to open the cut packaging material B by pairs of cutting blades 3, 3 and 4, 4 and a cutting blade 5, will be described in detail.

Figure 7:
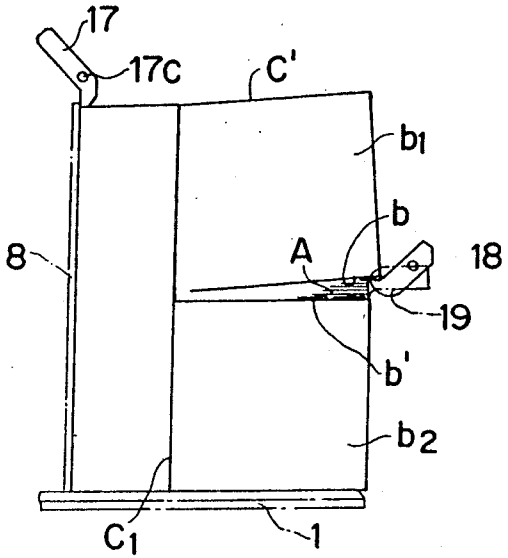
FIG. 7 is an enlarged side view showing the opening condition of a cut package.

As a means to open the cut packaging material B, the embodiment shows a case comprising a lever 17 to grasp the upper corner of the cut package C′ placed on the platform 1, as illustrated in FIG. 2, a stopper to transfer the package from the bottom to the top, and a stopper 19 to transfer the package from the top to the bottom. The bottom of the lever 17 is pivoted to the rod 17*b* of the lever 17*a*, and when the rod 17*b* penetrates in the direction of the arrow in FIG. 18, the lever rotates from its solid line position as shown by chain line with pivot 17*c* as the center and the top of the lever 17*a* grasps the upper corner of the package C′. Thereafter, the mouth of the cut packaging material B opens slightly, and the tip of the stopper 18 penetrates into the packaging material to hook the open edges and advances upwardly. In this manner, the upper half of the packaging material B shown by $b_1$ opens as shown by FIG. 3(*g*) and FIG. 7. Next, the upper stopper 19 goes down and the tip of the stopper 19 hooks the open edges b′ of $b_2$ of the packaging material B as illustrated in FIG. 7 and advances downwardly. Then the lower half of the packaging material shown by $b_2$ opens as shown by FIG. 3(*g*) and FIG. 7. In this manner, the cut package C′ is opened on the platform 1. In addition to the cases described in the embodiment, the opening operation can be performed to rip off the cut packaging material B by applying suction to either plane of the cut package C′.

As described above, a plurality of rectangular packages formed in a bundle of flattened blanks A with packaging material B can be automatically cut and opened.

Figure 12:
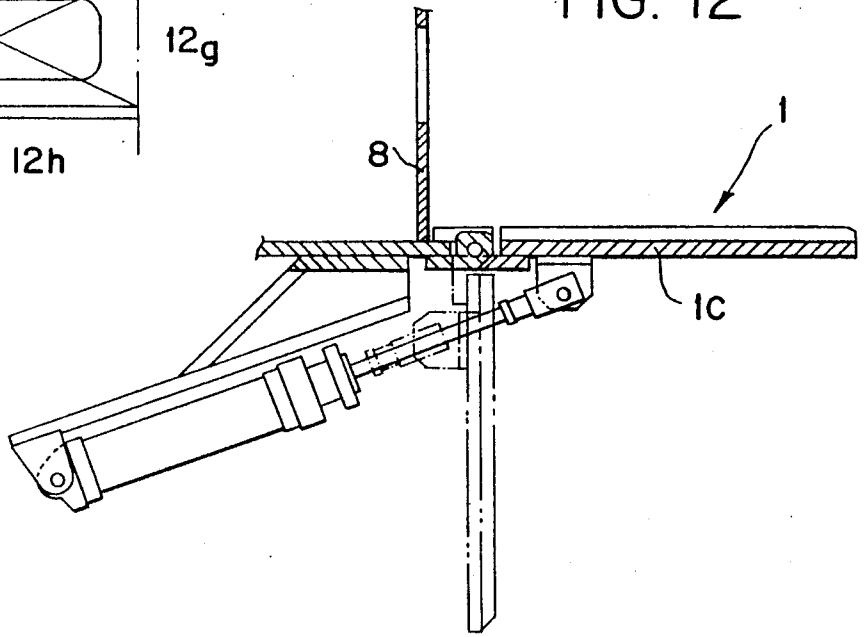
FIG. 12 is a partial side view showing the platform, which is a part of the package cutting and opening device, in extended and retracted positions.

Once opened, the packaging material B is no longer necessary, and only the flattened blanks need be taken out. In the embodiment, this can be done by a robot shown by 20 in FIG. 19. The robot 20 is equipped with a grasping means comprising a top-and-bottom pair of forks 20*a*, 20*a*, that approaches a cut package C″ on a platform 1 to take out only a plurality of stripped blanks A with the top-and-bottom pair of forks 20*a*, 20*a* as shown by FIG. 3(*h*). In this case, the front side 1*c* of the platform 1 can be laid down as shown by chain line in FIG. 12 to avoid conflict of the bottom fork of the pair of forks 20*a*, 20*a* with the platform 1.

A pusher 21 is illustrated in FIG. 18 for pushing the empty packaging material B after the plurality blanks A are taken out by the pair of forks 20*a*, 20*a* out of the platform 1. The pusher 21 may be moved forward tot he chain line position form the solid line position in FIG. 18 by the activation of cylinder 21*a*. The empty packaging material pushed out by the pusher 21 can be made to be discharged automatically by an unillustrated device.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A cutting and opening method for a rectangular package covered with packaging material comprising the steps of:

forming a space between the packaging material and the packaged items;

cutting the packaging material of a rectangular package from one edge to the other on two mutually opposing planes;

cutting the packaging material on said two planes from one of the two edges other than those passing a starting point and a finishing point of the cutting lines to the above-mentioned cutting step;

cutting the packaging material on a plane adjacent to the above-mentioned two planes and having two edges passing the two cutting lines wherein the two cutting lines are connected after forming a space between the packaging material and the packaged items;

opening the packaging material at each area on the three planes where cutting lines are provided; and inserting a backplate from a cut area made by cutting the packaging material from one edge to the other on each of the two mutually opposing planes, and said packaging material on the planes being cut on a surface of the backplate;

wherein a tip of the backplate inserted from the cut area on each of the two mutually opposing planes protrudes outward to form a space between the packaging material and the packaged items when cutting the plane adjacent to the two mutually opposing planes.

2. The cutting and opening method for a rectangular package covered with packaging material according to claim !, wherein rectangular packages of different sizes are accommodated and the positions of the cutting lines running from one edge to the other on the two mutually opposing planes are varied with respect to a datum plane adjacent to the two planes according to the package sizes.

3. A cutting and opening device for a rectangular package covered with packaging material comprising:

a platform for positioning a rectangular package;

spacing means for forming a space between the packaging material and the packaged items on two mutually opposing planes of the package on said platform;

a pair of cutting blades for cutting the packaging material from one edge to the other in the direction of height or width where a space is formed between the packaging material and the packaged items by said spacing means;

a pair of cutting blades for cutting the packaging material from one of the two edges other than the edges passing the starting point and the finishing point of each of the two cutting lines cut by the pair of cutting blades to the above-mentioned cutting lines;

a second spacing means for forming a space between the packaging material and the packaged items on the plane with two edges that pass the ends of the two cutting lines made by the pair of cutting blades;

a cutting blade for cutting the packaging material for connecting the two cutting lines on the above plane; and a device to open the packaging material from each area on the three planes provided with cutting lines.

4. The cutting and opening device for a rectangular package covered with packaging material according to claim 1, wherein a pair of holders for holding portions of the two mutually opposing planes of the rectangular package placed on the platform from both sides are provided on the side of the platform.

5. The cutting and opening device for a rectangular package covered with packaging material according to claim 1, and further including a pair of backplates movable parallel to the two mutually opposing planes of the rectangular package placed on the platform and insertable through slits made by cutting the packaging material from one edge to the other on these two planes.

6. The cutting and opening device for a rectangular package covered with packaging material according to claim 1, wherein different-sized rectangular packages are accommodated on said platform and said platform is position in relation to a cylinder for positioning the platform with respect to a datum plane is provided with a cutting line adjacent to the two planes that are cut from one edge to the other according to the package sizes.

7. The cutting and opening device for a rectangular package covered with packaging material according to claim 1, wherein when different-sized rectangular packages are placed on the platform, a pair of cutting blades are operatively connected to a cylinder so that the activation position of the pair of cutting blades for cutting the packaging material from one edge to the other in the direction of height or width on the two mutually opposing planes can be varied with respect to the datum plane to be provided with a cutting line and adjacent to the above two planes according to the package sizes.

8. The cutting and opening device for a rectangular package covered with packaging material according to claim 4, wherein when different-sized rectangular packages are placed on the platform, the aforementioned pair of holders is positioned in relation to a cylinder so that the activation position of the pair of holders can be varied with respect to the datum plane to be provided with a cutting line and adjacent to the two mutually opposing planes cut from one edge to the other according to the package sizes.

9. The cutting and opening device for a rectangular package covered with packaging material according to claim 1, wherein when different-sized rectangular packages are placed on the platform, a pair of spacing means for forming a space between the packaging material and the packaged items on the two mutually opposing planes are positioned in relation to a cylinder so that the position of the spacing means can be varied with respect to the datum plane to be provided with a cutting line and adjacent to the two mutually opposing planes cut from one edge to the other according to the package sizes.

10. The cutting and opening device for a rectangular package covered with packaging material according to claim 1, wherein when a rectangular package is pressed onto the platform, a backboard is provided at the back of the platform to position the back plane of the package with respect to the platform, and said backboard is positioned in relation to a cylinder so that the activation position of said backboard can be varied with respect to the datum plane to be provided with cutting lines and adjacent to the two mutually opposing planes cut from one edge to the other according to the package sizes to be placed on the platform.

11. The cutting and opening device for a rectangular package covered with packaging material according to claim 6, 7, 8, 9 or 10, wherein when a package is pressed into the platform from a place where the plane adjacent to the two planes cut from one edge to the other of each package is at a fixed position, the activation positions of the platform, a pair of cutting blades, a pair of holders, a pair of spacing means to form a space between the packaging material and the packaged items on the two planes of the package that are cut from one edge to the other, and the backboard, are positioned in relation to a cylinder so that they can be varied with respect to the datum plane of the package, and can be chosen according to the predetermined package sizes.

12. The cutting and opening device for a rectangular package covered with packaging material according to claim 11, wherein a package is transported in a storage box toward the prescribed position on the side of the platform.

* * * * *